United States Patent [19]

Shaw et al.

[11] 4,450,748

[45] May 29, 1984

[54] SOLID BODY GUITAR WITH SEALED CAVITY

[75] Inventors: Timothy P. Shaw; Abraham J. Wechter, both of Kalamazoo, Mich.

[73] Assignee: Norlin Industries, Inc., White Plains, N.Y.

[21] Appl. No.: 389,644

[22] Filed: Jun. 18, 1982

[51] Int. Cl.[3] ..... G10D 1/08

[52] U.S. Cl. ..... 84/291

[58] Field of Search ..... 84/267, 291, 292, 294, 84/295, 296

[56] References Cited

U.S. PATENT DOCUMENTS 4,188,850 2/1980 Kaman ..... 84/291
4,290,336 9/1981 Peavey ..... 84/291
4,334,452 6/1982 Morrison et al. ..... 84/1.16
4,359,923 11/1982 Brunet ..... 84/267

*Primary Examiner*—Lawrence R. Franklin
*Attorney, Agent, or Firm*—Ronald J. Kransdorf

[57] ABSTRACT

This invention relates to a solid body stringed musical instrument which is adapted to reproduce the acoustical characteristics of a hollowed body acoustic stringed musical instrument. In particular, the invention provides a sealed cavity formed in the area of the body substantially underlying the bass side of the instrument bridge, this cavity permitting the bass side of the bridge to move and flex substantially more than the treble side of the bridge to reduce the instrument sustain in the bass register and to balance the sustain levels of the instrument.

10 Claims, 3 Drawing Figures

SOLID BODY GUITAR WITH SEALED CAVITY

BACKGROUND OF THE INVENTION

This invention relates to solid body stringed musical instruments and more particularly to such an instrument which is designed to reproduce the acoustical characteristics of a hollowed body stringed musical instrument.

Fretted stringed musical instruments such as guitars have normally been of two types, solid body electric guitars capable of generating high volumes and long sustains such as are used in rock music and hollow body acoustic guitars with a shorter sustain, more mellow sound popular for example in country or classical music. While it is possible to put an electric pickup or microphone in an acoustic guitar to boost its output for performing before larger groups, the volume level outputs from these instruments are generally limited by resonant feedback which develops in the hollow body of such an instrument in high volume environments. In addition to volume limitations, acoustic guitars also have limited sustain characteristics, are relatively difficult and expensive to manufacture, particularly for high quality instruments, and are more susceptible to damage as a result of changes in temperature and humidity or as a result of abuse in handling such as might occur when travelling.

Since solid body guitars do not have a resonant cavity, and are therefore not susceptible to resonant feedback, there are few limitations on their volume output. Solid body instruments also have good sustain characteristics, are easier and less expensive to manufacture than acoustic instruments, and are substantially more durable, being less susceptible to damage as a result of changes in temperature and humidity or as a result of rough handling. It would therefore be desirable if a solid body guitar could be provided which would reproduce the sound characteristics of an acoustic instrument.

Instruments designed in the past to accomplish this objective have used nylon strings, the bass strings being wound, and a piezoelectric pickup, normally bridge mounted, in place of steel strings and a magnetic pickup. However, such instruments have a long sustain, which is most pronounced in the bass string area, and which gives a somewhat solid body electric guitar sound rather than a pure acoustical guitar sound to the instrument. The long sustain, particularly in the bass tones, is not typical of an acoustic guitar and requires players accustomed to playing a conventional acoustical guitar to consciously adapt their technique when playing such an instrument.

SUMMARY OF THE INVENTION

It is therefore an object of this invention to provide a solid body electric guitar which more nearly matches the sustain and other acoustic characteristics of a standard acoustical guitar.

While a solid body instrument using nylon (or as will be discussed later, metal) strings and a piezoelectric pickup in the bridge would tend to sustain somewhat more in the treble range than would a standard acoustical guitar, this added sustain may even be desirable and is not sufficient to cause the instrument to have a "electric" tone. However, the wound bass strings, being far more efficient drivers, sustain much more strongly, creating a sustain imbalance which is not characteristic of acoustic guitars and also creating a generally excessive sustain in the bass ranges.

In accordance with the teachings of this invention, the problem indicated above is overcome by providing a means in the body of the instrument for permitting the side of the instrument bridge overlayed by the bass strings to move and flex substantially more than the side of the bridge overlayed by the treble strings. This movement and flex causes the bass strings to lose energy at a more rapid rate than the treble strings which are firmly supported and tends to balance the sustain of both sets of strings at an acceptable level. In particular, a sealed cavity is formed in the solid body in the area thereof underlying the side of the bridge overlayed by the bass strings. For the preferred embodiment, this cavity is cylindrical in shape with a diameter substantially equal to or slightly greater than the length of the bass side of the bridge.

The foregoing and other objects, features and advantages of the invention will be apparent from the following more particular description of a preferred embodiment of the invention as shown in the accompanying drawings.

DETAILED DESCRIPTION OF THE PREFERRED EMBODIMENT

Figure 1:
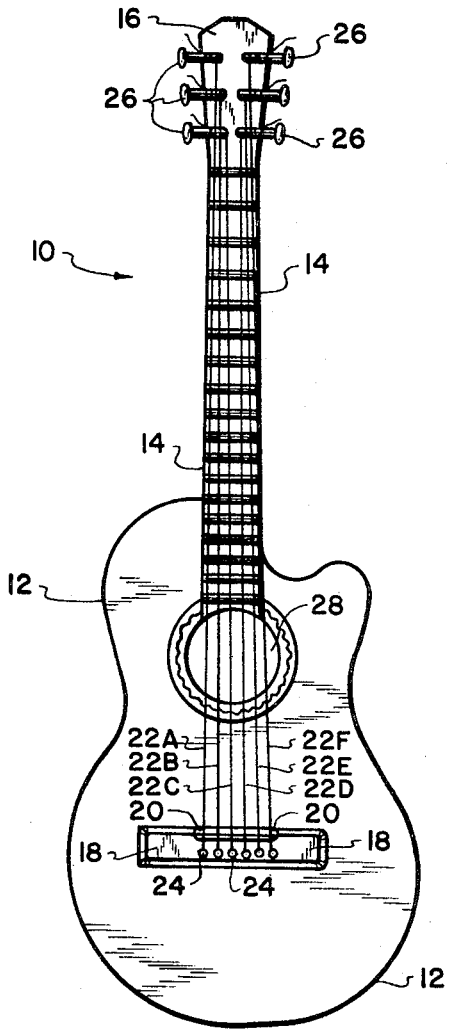
FIG. 1 is a top view of a guitar of a type suitable for incorporating the teachings of this invention.

Referring to the figures, and in particular FIG. 1, it is seen that a guitar 10 suitable for practicing the teachings of this invention includes a solid body 12 having a neck 14 projecting from the rear end thereof, neck 14 terminating in a peghead 16. A bridge 18 having a bridge saddle 20 fitted therein is mounted on body 12. An electrical pickup, preferably a piezoelectric or other pressure sensitive pickup (not shown) is mounted in and forms part of bridge saddle 20. A plurality of strings (six for the preferred embodiment of the invention shown in the figures) 22A–22F are attached at one end by pins 24 or other suitable means to bridge 18 and extend over bridge saddle 20 and the fingerboard of neck 14, being attached at their other ends to machine heads 26 mounted in peghead 16. A simulated sound hole 28 is formed in the top of body 12, the hole being present only for aesthetic purposes and having no acoustic effect on the instrument.

Figure 3:
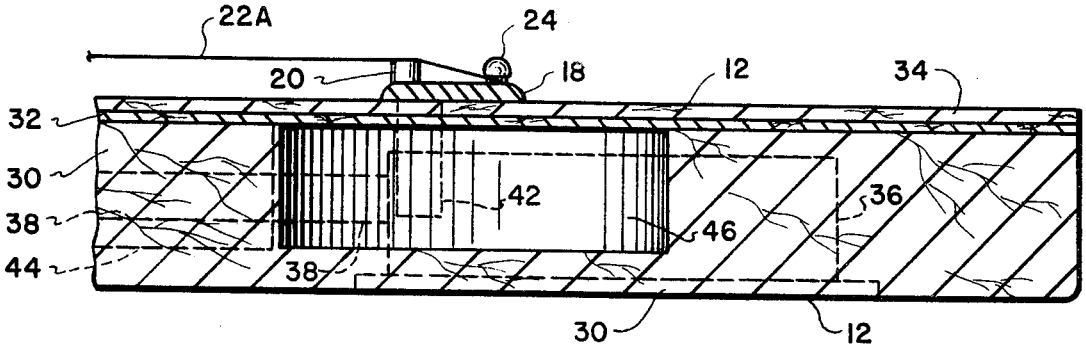
FIG. 3 is a side sectional view of a portion of the guitar body taken along the line 3—3 of FIG. 2.
Figure 2:
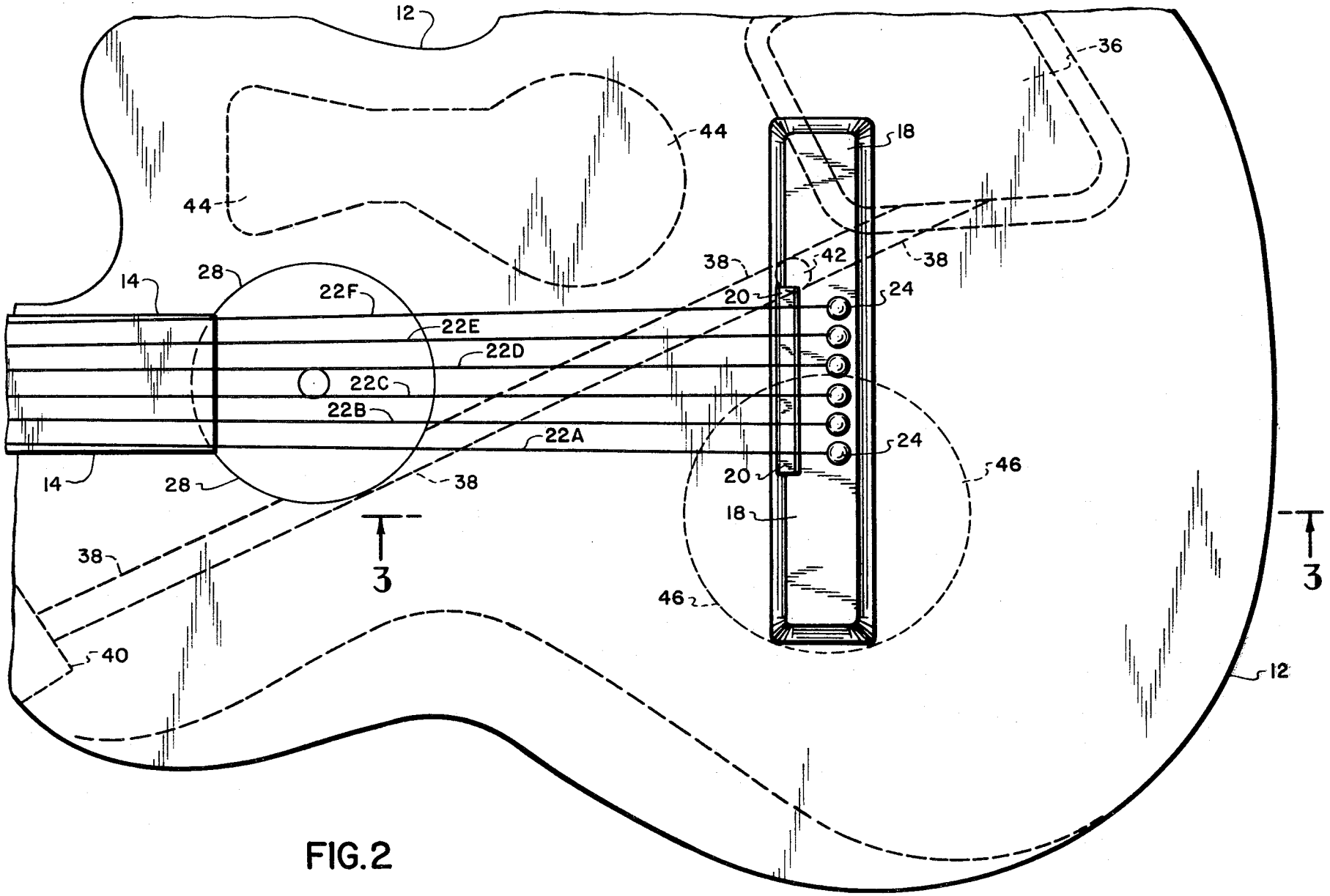
FIG. 2 is an enlarged top view of a portion of the body of the guitar shown in FIG. 1 illustrating the teachings of this invention.

As may be best seen in FIG. 3, body 12 is composed of a three part sandwich of wooden layers which are preferably glued together. For a preferred embodiment, the bottom layer 30 is of mahogany and is approximately 1-11/16" thick. The middle layer 32 is a spruce or basswood crossband and is only 1/16" thick. The top layer 34 is a ⅛" thick piece of spruce.

A plurality of cavities are routed or otherwise formed in layer 30 of body 12. Cavity 36 is formed on the underside of layer 30 and is adopted for housing the electronics hardware of the instrument. Cavity 36 is connected by a cable channel 38 to cavity 40 adapted for housing the instrument volume and tone controls. A hole 42 leading from channel 40 through layers 32 and 34 to the top surface of body 12 under bridge 18 permits the pickup (not shown) in bridge saddle 20 to be electrically connected to the electronics hardware in cavity 36. A cavity 44 is provided in the treble side of the instrument primarily for weight reduction purposes and a cavity 46 is provided under the bass side of bridge 18 for purposes which will be described in greater detail later. For the preferred embodiment, cavities 44 and 46 are routed to a depth of approximately $1\frac{1}{4}''$ in layer 30 and are both sealed and concealed from view when layers 32 and 34 are glued on.

Strings 22A–22C are the bass strings of the instrument and would normally be wound nylon strings. Strings 22D–22F are the treble strings of the instrument and would normally be plain nylon strings. As previously indicated, the wound bass strings are far more efficient drivers than the plain treble strings causing the instrument 10 to sustain more strongly in the bass frequency ranges than the treble frequency ranges. This sustain imbalance is not characteristic of acoustic guitars and the heavy sustain in the bass register tends to give the instrument a somewhat electric sound rather than purely an acoustical sound.

To overcome this problem, and in accordance with the teachings of this invention, a means is provided in body 12 for causing the bass strings 22A–22C to lose energy, and thus sustain, at a more rapid rate than treble strings 22D–22F. In particular, cavity 46 is positioned under the bass side of bridge 18 and is cylindrical in shape with a diameter which is substantially equal to the length of the bass side of the bridge. This cavity is of sufficient size to allow the bass side of the bridge to move and flex, much as it would were the instrument of a traditional hollow construction.

It has been found that a sealed cavity such as cavity 46 will adequately decrease the sustain in the bass registers, will balance the output of the wound and plain strings, and will produce a timbre very close to that obtained from a standard acoustic guitar provided the dimensions and positioning of the cavity are properly selected. For best results, the volume of the cavity should preferably be between 10 $in^3$ and 16 $in^3$ and should be positioned so that it underlies substantially the entire bass side of the bridge but does not underlie any significant portion of the treble side of bridge 18. By keeping the cavity size within the dimensions indicated, and by using the sandwich construction with the crossband layer 32, there is no need for additional bracing on the cavity as is the case with traditional acoustic instruments. The limitations on cavity size are that if the cavity is too small, it will not permit sufficient movement and flex on the bass side of the bridge and will therefore not achieve the desired sustain reduction in the bass register. If the cavity is too large, it can produce an undesirable resonance or "wolf tone" and may also allow the top to deform under string tension making it necessary to use additional bracing to support top layers 32 and 34.

While for the preferred embodiment shown in the figures, a cylindrical cavity 46 has been shown, cavities having other shapes such as an oval shape or generally rectangular shape might be utilized, assuming the cavities were properly positioned and conformed to the volume limitations indicated above. Further, while for the preferred embodiment, plain nylon treble strings and wound nylon bass strings have been assumed, most of the advantages indicated above would be achieved with an instrument using plain and wound steel or other metal strings for the treble and bass respectively. With metal strings, a fourth string would typically be wound. It may therefore be desirable to enlarge cavity 46 slightly in the direction of this fourth string to help balance its sustain.

Thus, while the invention has been particularly shown and described above with reference to a preferred embodiment, the foregoing and other changes in form and detail may be made therein without departing from the spirit and scope of the invention.

What is claimed is:

1. A solid body for a musical instrument, said instrument having a bridge mounted on said body, a plurality of bass strings and a plurality of treble strings, each string being anchored at both ends to said instrument and extending over said bridge, said body having an upper surface on which said bridge is mounted and a lower surface and being characterized by a sealed cavity formed between, but not extending through said upper and lower surfaces in the area thereof substantially underlying the portion of said bridge extended over by said bass strings.

2. A body as claimed in claim 1 wherein the cavity is cylindrical in shape.

3. A body as claimed in claim 2 wherein the diameter of said cylindrical cavity is substantially equal to half the length of the bridge of said instrument.

4. A body as claimed in claim 2 wherein the volume of said cavity is between 10 and 16 cubic inches.

5. A body as claimed in claim 1 wherein the volume of said cavity is between 10 and 16 cubic inches.

6. A body as claimed in claim 1 wherein said body is formed of three layers of wood sandwiched together, a lower layer comprising most of the thickness of said body and having said cavity formed therein, a center, relatively thin, crossband layer overlaying said cavity, and a slightly thicker layer forming the upper surface of said body, said upper two layers sealing said cavity when they are mounted to said lower layer.

7. A solid body for a stringed musical instrument which instrument is intended to have the sound characteristics of a hollow bodied instrument, said instrument having a bridge mounted on said body, a plurality of bass strings and a plurality of treble strings, each string being anchored at both ends to said instrument and extending over said bridge, said body being characterized by having means for permitting the side of said bridge overlayed by said bass strings to move and flex substantially more than the side of said bridge overlayed by said treble strings.

8. A body as claimed in claim 7 wherein said means for permitting includes a sealed cavity formed within said body in the area thereof underlying the side of said bridge overlayed by said bass strings.

9. A body as claimed in claim 8 wherein the cavity is cylindrical in shape.

10. A body as claimed in claim 8 wherein the volume of said cavity is between 10 and 16 cubic inches.

* * * * *